US007370614B2

(12) United States Patent
Masaoka et al.

(10) Patent No.: US 7,370,614 B2
(45) Date of Patent: May 13, 2008

(54) ELECTROMAGNETICALLY DRIVEN VALVE

(75) Inventors: Toshika Masaoka, Toyota (JP); Masahiko Asano, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 124 days.

(21) Appl. No.: 10/586,779

(22) PCT Filed: Jun. 16, 2005

(86) PCT No.: PCT/JP2005/011491

§ 371 (c)(1),
(2), (4) Date: Jul. 21, 2006

(87) PCT Pub. No.: WO2006/013682

PCT Pub. Date: Feb. 9, 2006

(65) Prior Publication Data

US 2007/0151531 A1 Jul. 5, 2007

(30) Foreign Application Priority Data

Aug. 4, 2004 (JP) ..... 2004-228102

(51) Int. Cl.
*F01L 9/04* (2006.01)

(52) U.S. Cl. ..... 123/90.11; 251/129.01; 310/216; 335/128

(58) Field of Classification Search ..... 123/90.11; 251/129.01, 129.15, 129.16, 129.18; 310/215, 310/216; 335/128, 256
See application file for complete search history.

(56) References Cited

U.S. PATENT DOCUMENTS 4,515,343 A 5/1985 Pischinger et al.
6,467,441 B2 10/2002 Cristiani et al.
6,516,758 B1 * 2/2003 Leiber ..... 123/90.11
2003/0177989 A1 9/2003 Baker

FOREIGN PATENT DOCUMENTS

| | | |
|---|---|---|
| DE | 39 11 496 A1 | 10/1990 |
| DE | 196 28 860 A1 | 1/1998 |
| DE | 102 33 043 A1 | 2/2004 |
| EP | 1 106 793 A1 | 6/2001 |
| EP | 1 136 660 A1 | 9/2001 |
| JP | 09-133010 | 5/1997 |

* cited by examiner

*Primary Examiner*—Ching Chang
(74) *Attorney, Agent, or Firm*—Kenyon & Kenyon LLP

(57) ABSTRACT

An electromagnetically driven valve includes a driven valve having a stem and carrying out reciprocating motion along a direction in which the stem extends, a disc support base having an abutment surface, a disc extending from one end coupled to the stem toward the other end supported by the disc support base so as to allow free oscillation of the disc, and an electromagnet applying electromagnetic force to the disc. The disc has a root portion formed at the other end, and an arm portion formed from the root portion to one end. The electromagnet has a surface facing the arm portion. When the disc is attracted to the electromagnet the abutment surface abuts on the root portion and a gap is created between the surface and the arm portion. With such a structure, excellent quietness and durability can be achieved and energy loss can be reduced.

3 Claims, 8 Drawing Sheets

ELECTROMAGNETICALLY DRIVEN VALVE

This is a 371 national phase application of PCT/JP2005/011491 filed 16 Jun. 2005, which claims priority to Japanese Patent Application No. 2004-228102 filed 04 Aug. 2004, the contents of which are incorporated herein by reference.

TECHNICAL FIELD

The present invention generally relates to an electromagnetically driven valve, and more particularly to an electromagnetically driven valve of a rotary drive type used in an internal combustion engine.

BACKGROUND ART

As a conventional electromagnetically driven valve, for example, U.S. Pat. No. 6,467,441 specification discloses an electromagnetic actuator actuating valves of an internal combustion engine as a result of cooperation of electromagnetic force and a spring. The electromagnetic actuator disclosed in the specification is called a rotary drive type, and includes a valve having a stem and an oscillating arm having a first end hinged on a support frame and a second end in abutment on the upper end of the stem.

An electromagnet consisting of a core and a coil wound around the core is arranged above and below the oscillating arm. The electromagnetic actuator further includes a torsion bar provided at the first end of the oscillating arm and moving the valve toward a position of maximum opening and a helical spring arranged on an outer circumference of the stem and moving the valve toward a closed position. The oscillating arm oscillates using the first end as a fulcrum, in a manner alternately attracted to and contacted with the cores of the electromagnets arranged above and below the same.

Japanese Patent Laying-Open No. 09-133010 discloses an apparatus for electromagnetically driving a valve called a parallel drive type, which aims at power saving and improvement in response. The apparatus for electromagnetically driving a valve disclosed in this publication includes a valve element having a valve shaft fixed. The valve shaft is connected to a ring-shaped plunger through a plunger holder. A first electromagnetic coil and a first core are disposed above the plunger, and a second electromagnetic coil and a second core are disposed below the same. An upper spring moving the plunger downward is disposed further above the first electromagnetic coil and the first core, and a lower spring moving the plunger upward is disposed further below the second electromagnetic coil and the second core.

In the parallel drive type apparatus, an electromagnet constituted of an electromagnetic coil and a core and applying electromagnetic force to the plunger, and an upper spring and a lower spring applying elastic force to the valve shaft are arranged in series in a direction in which the valve shaft extends. According to such a structure, the electromagnetic force and the elastic force directly act on the valve shaft, so as to cause the valve element to carry out reciprocating motion.

According to the electromagnetic actuator disclosed in U.S. Pat. No. 6,467,441 specification, the oscillating arm comes in contact with an entire end surface of the core of the electromagnet when the oscillating arm is attracted to and contacts with the electromagnet. Accordingly, sound produced by collision between the oscillating arm and the electromagnet is great, and quietness when the electromagnetic actuator is driven is not satisfactory. In addition, as large repeated load is imposed on the oscillating arm moving at a high speed, the arm tends to be fractured in the vicinity of the first end. In order to solve this problem, it is possible to improve strength by increasing an overall thickness of the oscillating arm. In this case, however, a weight of the oscillating arm becomes too large, resulting in increase in energy loss.

In addition, according to the electromagnetic actuator disclosed in U.S. Pat. No. 6,467,441 specification, collision between the oscillating arm and the core of the electromagnet is repeated, which results in a problem of durability of the electromagnet. If the core is broken, the electromagnet should be exchanged, which impairs maintenance performance of the electromagnetic actuator. Such a problem also occurs in the apparatus for electromagnetically driving a valve disclosed in Japanese Patent Laying-Open No. 09-133010.

DISCLOSURE OF THE INVENTION

The present invention was made to solve the above-described problems, and an object of the present invention is to provide an electromagnetically driven valve attaining excellent quietness and durability as well as reduction in energy loss.

An electromagnetically driven valve according to the present invention includes: a driven valve having a valve shaft and carrying out reciprocating motion along a direction in which the valve shaft extends; a support member having an abutment surface and provided in a position spaced apart from the driven valve; an oscillating member extending from one end coupled to the valve shaft to the other end supported by the support member so as to allow free oscillation of the oscillating member; and an electromagnet applying electromagnetic force to the oscillating member. The oscillating member has a root portion formed at the other end and an arm portion formed from the root portion to one end. The electromagnet has a surface facing the arm portion. When the oscillating member is attracted to the electromagnet, the abutment surface abuts on the root portion and a gap is created between the surface and the arm portion.

According to the electromagnetically driven valve structured as above, only the root portion formed at the other end comes in contact with the support member, and the arm portion formed from the root portion to one end does not come in contact with the electromagnet. Accordingly, sound produced when the oscillating member oscillates is lowered, and quietness when the electromagnetic actuator is driven can be improved. In addition, as the oscillating member does not come in contact with the electromagnet, the electromagnet is not broken due to the repeated load imposed by the oscillating member. Therefore, durability of the electromagnetically driven valve can be improved.

Preferably, the oscillating member is formed such that the arm portion has a thickness smaller than that of the root portion. The term "thickness" herein refers to a dimension of each portion in a direction orthogonal to a surface of the electromagnet when the oscillating member is attracted to the electromagnet.

According to the electromagnetically driven valve structured as above, the strength of the root portion can be improved by having a relatively large thickness. This prevents the root portion from being broken due to the repeated load, and durability of the electromagnetically driven valve can further be improved. In addition, as the arm portion has a relatively small thickness, weight of the oscillating member can be smaller. In this manner, energy loss due to increase in weight of the oscillating member can be suppressed, and power consumed in the electromagnet can be reduced. Concurrently, bending moment imposed on the other end side of the oscillating member is made smaller, so as to prevent breakage of the root portion.

Preferably, the root portion is formed from a material of higher strength than the arm portion. According to the electromagnetically driven valve structured as above, as the root portion receiving the repeated load is formed from a material of high strength, prevention of breakage of the root portion can further be ensured.

As described above, according to the present invention, an electromagnetically driven valve attaining excellent quietness and durability as well as reduction in energy loss can be provided

BEST MODES FOR CARRYING OUT THE INVENTION

Figure 1:
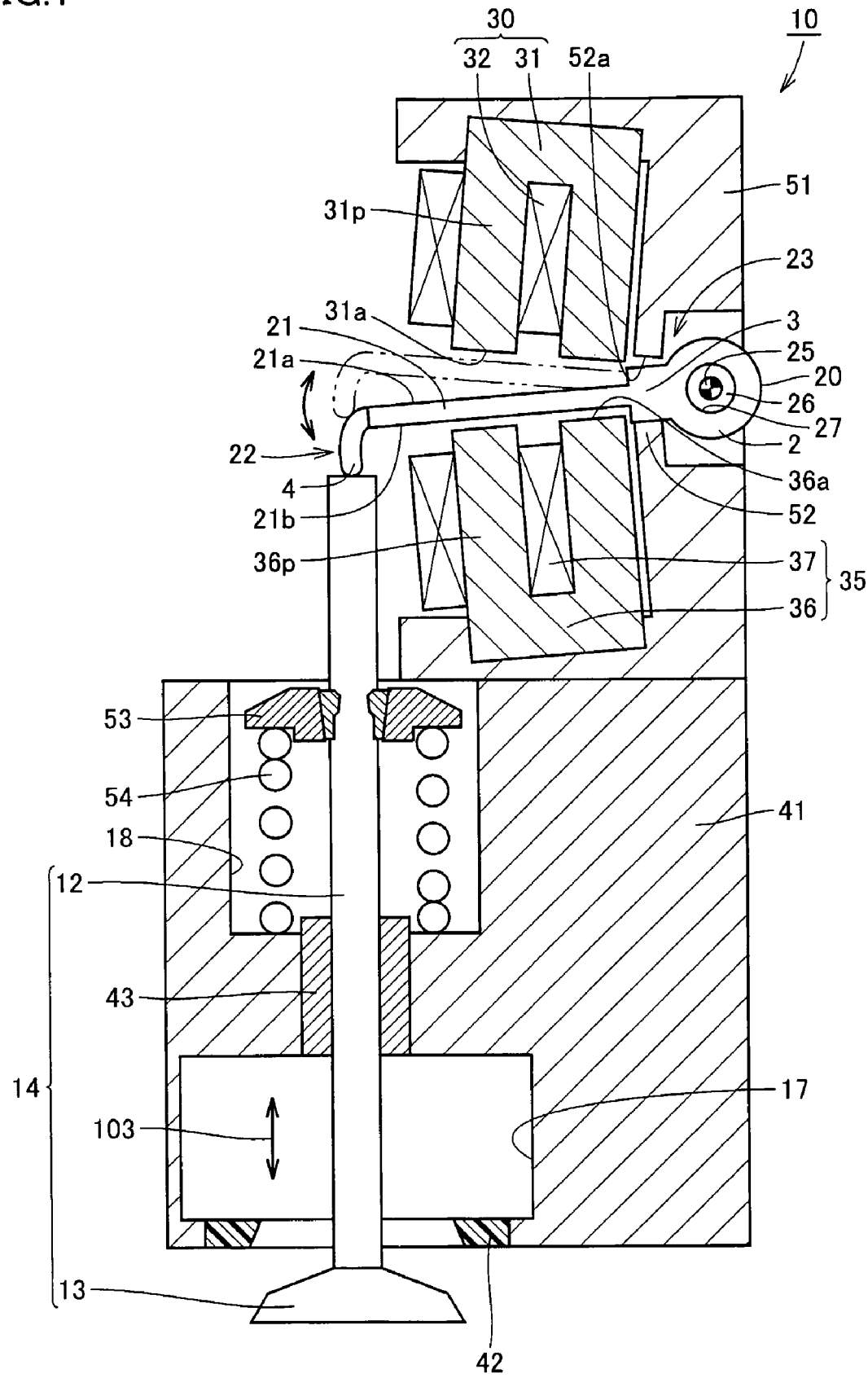
FIG. 1 is a cross-sectional view showing an electromagnetically driven valve according to a first embodiment of the present invention.

Embodiments of the present invention will be described with reference to the drawings. In the drawings hereinafter, the same or corresponding elements have the same reference characters allotted.

First Embodiment

An electromagnetically driven valve according to the present embodiment implements an engine valve (an intake valve or an exhaust valve) in an internal combustion engine such as a gasoline engine or a diesel engine. In the present embodiment, description will be given assuming that the electromagnetically driven valve implements an intake valve, however, it is noted that the electromagnetically driven valve is similarly structured when it implements an exhaust valve.

Referring to FIG. 1, an electromagnetically driven valve 10 is a rotary drive type electromagnetically driven valve. Electromagnetically driven valve 10 includes a driven valve 14 having a stem 12 extending in one direction, a disc support base 51 provided in a manner aligned with stem 12 at a position spaced apart from stem 12, a disc 20 oscillating by receiving electromagnetic force and elastic force applied thereto, electromagnets 30 and 35 arranged above and below disc 20 and generating the electromagnetic force, and an upper spring 26 and a lower spring 54 having the elastic force.

One end 22 of disc 20 abuts on a tip end of stem 12, and the other end 23 is coupled to disc support base 51 so as to allow free oscillation of the disc. A torsion bar implements upper spring 26, and a helical spring implements lower spring 54. Driven valve 14 carries out the reciprocating motion in the direction in which stem 12 extends (a direction shown with an arrow 103), upon receiving the oscillating movement of disc 20.

Driven valve 14 is mounted on a cylinder head 41 having an intake port 17 formed. A valve seat 42 is provided in a position where intake port 17 of cylinder head 41 communicates to a not-shown combustion chamber. Driven valve 14 further includes an umbrella-shaped portion 13 formed at the tip end of stem 12 on a side opposite to the tip end abutting on disc 20. The reciprocating motion of driven valve 14 causes umbrella-shaped portion 13 to intimately contact with valve seat 42 or to move away from valve seat 42, so as to open or close intake port 17. In other words, when stem 12 is elevated, driven valve 14 is positioned at a valve-closing position. On the other hand, when stem 12 is lowered, driven valve 14 is positioned at a valve-opening position.

In cylinder head 41, a valve guide 43 for slidably guiding stem 12 in an axial direction is provided. Valve guide 43 is formed from a metal material such as stainless steel in order to endure high-speed slide movement with respect to stem 12. A collar-shaped lower retainer 53 is provided on an outer circumferential surface of stem 12 at a position apart from valve guide 43. Cylinder head 41 has an opening 18 opening toward a top surface formed. Opening 18 accommodates lower spring 54 such that lower spring 54 is sandwiched between a bottom surface of opening 18 and lower retainer 53. Lower spring 54 applies the elastic force to driven valve 14 in such a direction that lower retainer 53 moves away from the bottom surface of opening 18, that is, in a direction elevating stem 12.

Disc support base 51 has a substantially C-shaped cross-section, and contains electromagnet 30 and electromagnet 35 in an upper portion and a lower portion in its enclosed space respectively. Electromagnet 30 is constituted of a coil 32 and a core 31 formed from a magnetic material and having a surface 31*a*. Core 31 has a shaft portion 31*p*, while coil 32 is provided in a manner wound around shaft portion 31*p*. Electromagnet 35 is also constituted of a coil 37 and a core 36 having a surface 36*a*, as in electromagnet 30. Core 36 has a shaft portion 36*p*, while coil 37 is provided in a manner wound around shaft portion 36*p*. Surfaces 31*a* and 36*a* face each other with a space therebetween, and a space in which disc 20 oscillates is defined between surface 31*a* and surface 36*a*.

Figure 2:
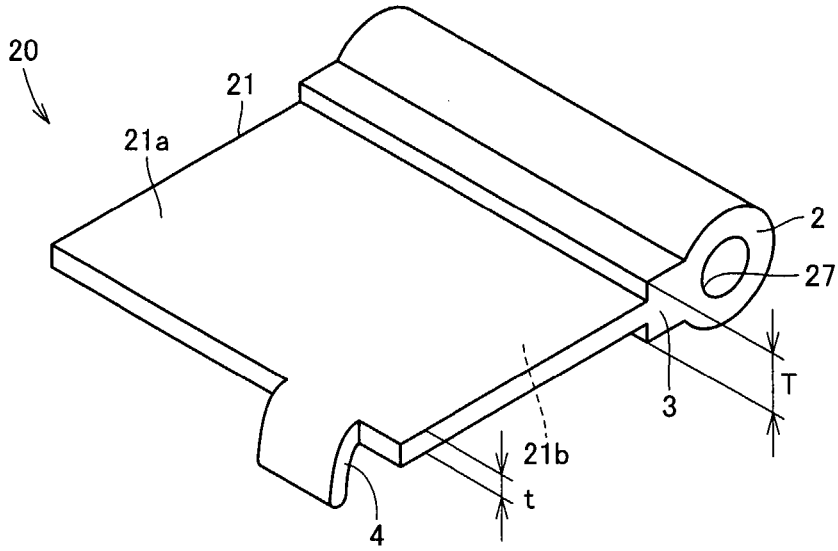
FIG. 2 is a perspective view showing a disc in FIG. 1.

Referring to FIGS. 1 and 2, disc 20 is formed from a ferromagnetic material of high strength. Disc 20 extends from one end 22 to the other end 23 in a direction intersecting stem 12. Disc 20 includes an arm portion 21 having rectangular surfaces 21*a* and 21*b* and formed from one end 22 to the other end 23. Surfaces 21*a* and 21*b* face surface 31*a* of electromagnet 30 and surface 36*a* of electromagnet 35 respectively. A projection 4 projecting from an edge of arm portion 21 is formed at one end 22 of disc 20. Projection 4 extends in a curved manner, and abuts on stem 12 at its tip end.

A hollow cylindrical shaft-receiving portion 2 having a hole 27 penetrated is formed at the other end 23 of disc 20. Disc 20 has a root portion 3 located at the other end 23 and extending between shaft-receiving portion 2 and arm portion 21. Root portion 3 has a thickness T, while arm portion 21 has a thickness t smaller than thickness T. According to such a structure, disc 20 is formed with steps being provided between surfaces 21*a* and 21*b* of arm portion 21 and root portion 3 respectively. For example, thickness T is set to 6 mm, thickness t is set to 4 mm, and the height of the steps lying between surfaces 21*a* and 21*b* and root portion 3 is set to 1 mm.

Upper spring 26 is press-fitted in hole 27, and disc 20 is supported on disc support base 51 with upper spring 26 being interposed. According to such a structure, disc 20 is provided in a freely oscillating manner around fulcrum 25 located at the other end 23. Upper spring 26 applies the elastic force to disc 20 in such a direction that disc 20 pivots counterclockwise around fulcrum 25, that is, in a direction lowering stem 12. While the electromagnetic force from electromagnets 30 and 35 is not applied, disc 20 is positioned by upper spring 26 and lower spring 54 at a position intermediate between an oscillation end on a valve-opening side and an oscillation end of a valve-closing side.

A pair of abutment portions 52 located above and below root portion 3 and having an abutment surface 52*a* is provided in disc support base 51. When root portion 3 abuts on abutment surface 52*a*, disc 20 is positioned at the oscillation end on the valve-opening side and the valve-closing side. More specifically, if root portion 3 abuts on lower abutment surface 52*a*, disc 20 is at the oscillation end on the valve-opening side. If root portion 3 abuts on upper abutment surface 52*a*, disc 20 is at the oscillation end on the valve-closing side.

When disc 20 is at the oscillation end on the valve-opening side, that is, when disc 20 is attracted toward electromagnet 35, a gap is created between surface 21*b* of arm portion 21 and surface 36*a* of electromagnet 35. Similarly, when disc 20 is at the oscillation end on the valve-closing side, that is, when disc 20 is attracted toward electromagnet 30, a gap is created between surface 21*a* of arm portion 21 and surface 31*a* of electromagnet 30. A width of the gap is, for example, 1 mm or smaller. According to such a structure, disc 20 oscillates in a space defined between surface 31*a* and surface 36*a*, with root portion 3 repeating abutment on abutment surface 52*a* but arm portion 21 not contacting with electromagnets 30 and 35.

Figure 3:
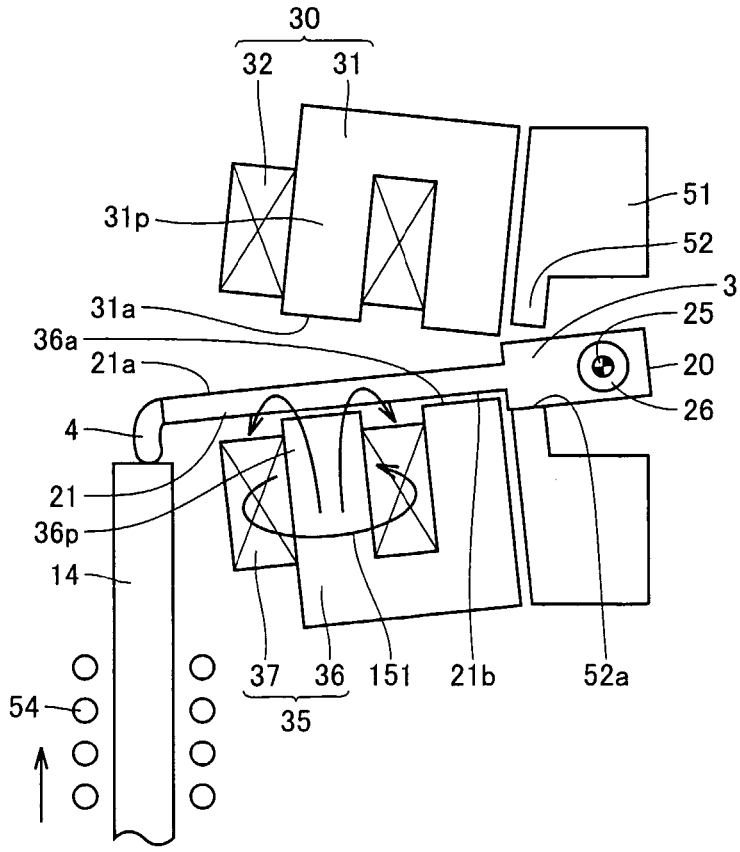
FIG. 3 is a schematic diagram showing the disc at an oscillation end on a valve-opening side.

An operation of electromagnetically driven valve 10 will now be described. Referring to FIG. 3, when driven valve 14 is at the valve-opening position, coil 37 is supplied with a current flowing in a direction shown with an arrow 151 around shaft portion 36*p* of core 36. Accordingly, magnetic flux flows in core 36 in a prescribed direction, and the electromagnetic force attracting disc 20 toward surface 36*a* of electromagnet 35 is generated. On the other hand, disc 20 resists the elastic force of lower spring 54, and is held at the oscillation end on the valve-opening side shown in FIG. 3. Here, root portion 3 abuts on abutment surface 52*a*, and a gap is created between surface 21*b* of arm portion 21 and surface 36*a* of electromagnet 35.

Figure 4:
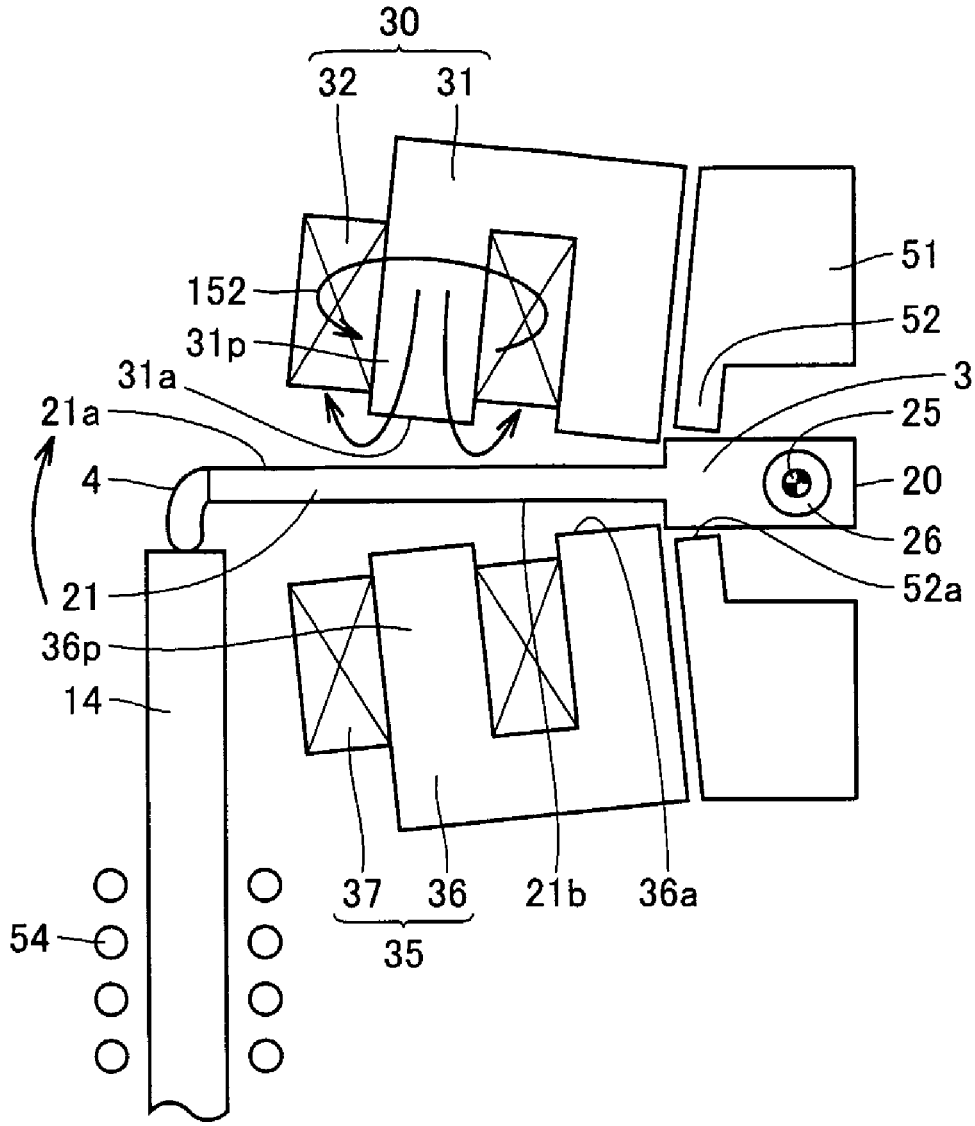
FIG. 4 is a schematic diagram showing the disc at an intermediate position.

Referring to FIG. 4, simultaneously with stop of current supply to coil 37, a current flowing in a direction shown with an arrow 152 around shaft portion 31*p* of core 31 is supplied to coil 32. Then, the electromagnetic force generated by electromagnet 35 disappears, and magnetic flux flows in core 31 in a prescribed direction, whereby the electromagnetic force attracting disc 20 toward surface 31*a* of electromagnet 30 is generated. Disc 20 starts to oscillate toward the intermediate position upon receiving the electromagnetic force generated by electromagnet 30 and the elastic force of lower spring 54.

Figure 5:
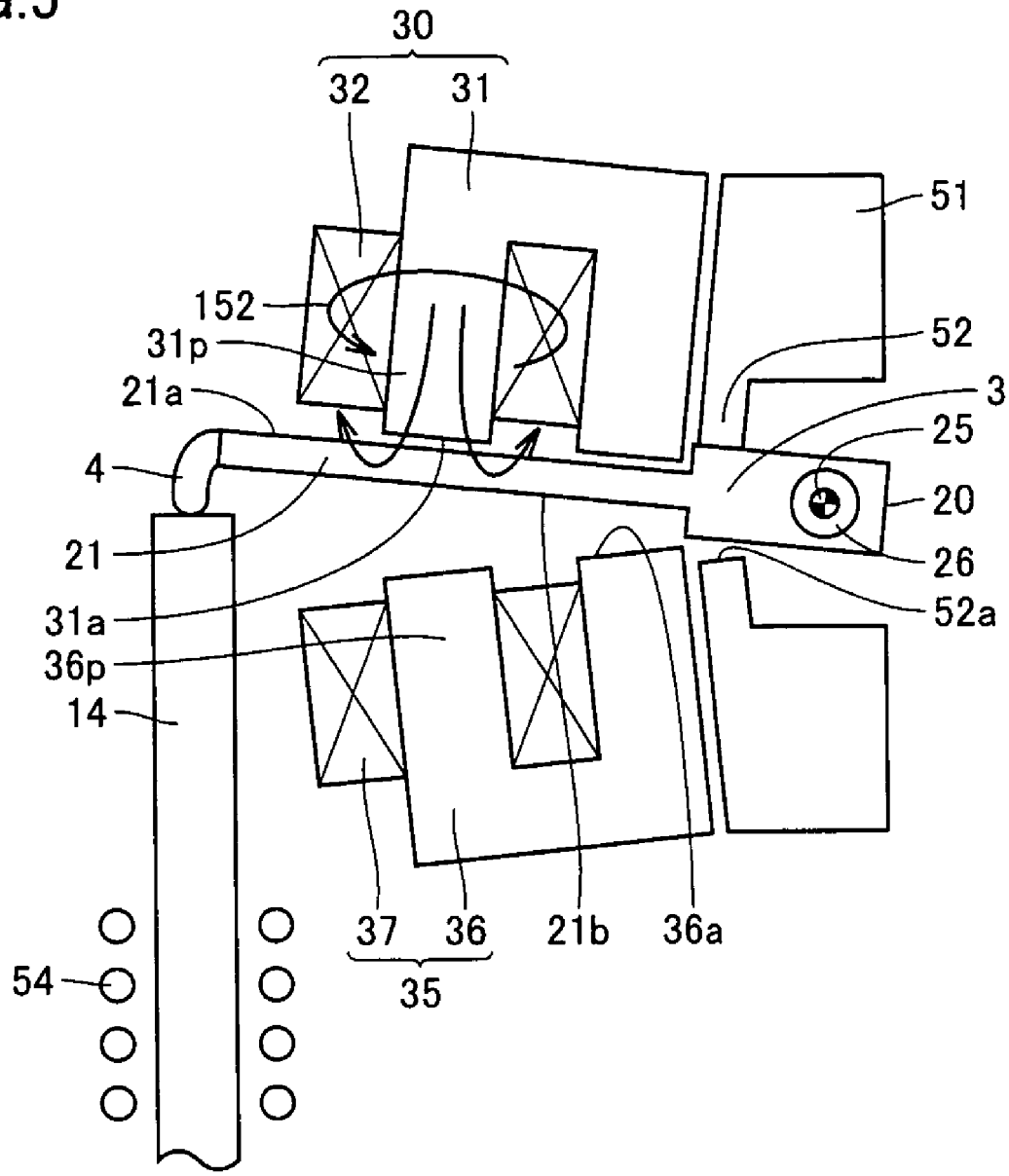
FIG. 5 is a schematic diagram showing the disc at an oscillation end on a valve-closing side.

Referring to FIG. 5, at a position beyond the intermediate position, disc 20 oscillates toward the oscillation end on the valve-closing side shown in FIG. 5 against the elastic force of upper spring 26, upon receiving the electromagnetic force generated by electromagnet 30. Here, root portion 3 abuts on abutment surface 52*a*, and a gap is created between surface 21*a* of arm portion 21 and surface 31*a* of electromagnet 30. In succession, simultaneously with stop of current supply to coil 32, a current flowing in a direction shown with arrow 151 described with reference to FIG. 3 is supplied to coil 37. Disc 20 again starts to oscillate toward the oscillation end on the valve-opening side.

Thereafter, current supply to coils 32 and 37 is repeatedly started and stopped at a timing described above. In this manner, disc 20 is caused to oscillate between the oscillation ends on the valve-opening side and the valve-closing side, so that driven valve 14 carries out the reciprocating motion as a result of this oscillating movement.

Electromagnetically driven valve 10 according to the first embodiment of the present invention includes driven valve 14 having stem 12 serving as the valve shaft and carrying out the reciprocating motion along the direction in which stem 12 extends, disc support base 51 having abutment surface 52*a* and serving as a support member provided at a position spaced apart from driven valve 14, disc 20 serving as the oscillating member extending from one end 22 coupled to stem 12 toward the other end 23 supported by disc support base 51 so as to allow free oscillation of the disc, and electromagnets 30 and 35 applying the electromagnetic force to disc 20. Disc 20 has root portion 3 formed at the other end 23 and arm portion 21 formed from root portion 3 to one end 22. Electromagnets 30 and 35 have surfaces 31*a* and 36*a* facing arm portion 21 respectively. When disc 20 is attracted to electromagnets 30 and 35, root portion 3 abuts on abutment surface 52*a*, and a gap is created between surfaces 31*a* and 36*a* and arm portion 21.

Arm portion 21 formed from a magnetic material is a portion to which electromagnetic force generated by electromagnets 30 and 35 is applied. Electromagnets 30 and 35 have cores 31 and 36 provided with surfaces 31*a* and 36*a*, respectively. When disc 20 oscillates, cores 31 and 36 are constantly in a state not contacting with disc 20. The gap created between surfaces 31*a* and 36*a* and arm portion 21 respectively has a substantially uniform width.

According to electromagnetically driven valve 10 in the first embodiment of the present invention structured as above, when disc 20 is at the oscillation end on the valve-opening side and the valve-closing side, root portion 3 abuts on abutment surface 52*a*, and a gap is created between arm portion 21 and electromagnets 30 and 35. As such, an area of collision between disc 20 and the electromagnet when disc 20 reaches the oscillation end is smaller, so that sound of collision can be lowered. In addition, as cores 31 and 36 constituting electromagnets 30 and 35 do not receive impact from disc 20, breakage of cores 31 and 36 can be prevented.

In addition, as root portion 3 is located in the vicinity of fulcrum 25 serving as the oscillation center of disc 20, the speed when root portion 3 collides with abutment surface 52*a* is slower than on one end 22 side distant from fulcrum 25. Therefore, sound produced by collision between root portion 3 and abutment surface 52*a* can effectively be lowered. Concurrently, since the impact as a result of collision between root portion 3 and abutment surface 52*a* is also lowered, fracture or crack of root portion 3 can be prevented. This is an effect specific to electromagnetically driven valve 10 of a rotary drive type according to the present embodiment, as compared with the electromagnetically driven valve of a parallel drive type in which an armature attracted by the electromagnetic force moves by a net stroke of the driven valve and collides with the electromagnet.

Moreover, according to the present embodiment, root portion 3 has relatively large thickness T. Therefore, root portion 3 has improved strength, and prevention of breakage of root portion 3 can be ensured. Meanwhile, arm portion 21 in which particularly high strength is not required has relatively small thickness t. Therefore, the total weight of disc 20 is reduced, and electric power to be introduced into coils 32 and 37 can be suppressed.

Second Embodiment

An electromagnetically driven valve according to the present embodiment is structured basically in a manner similar to electromagnetically driven valve 10 in the first embodiment. Therefore, description of a redundant structure will not be repeated.

Figure 6:
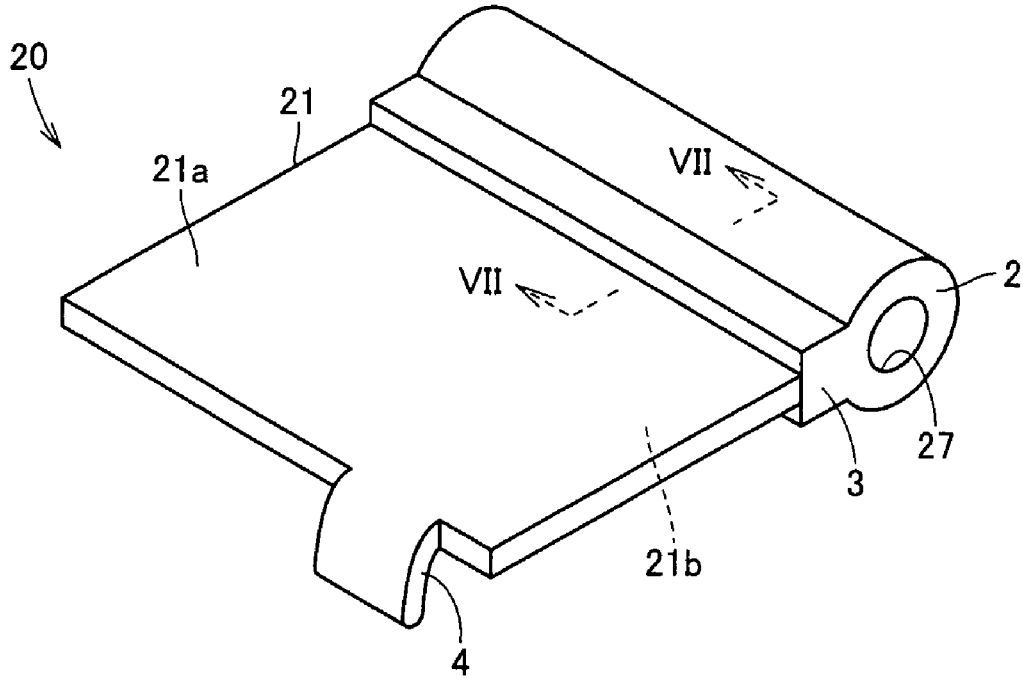
FIG. 6 is a perspective view showing a disc used in an electromagnetically driven valve according to a second embodiment of the present invention.

Referring to FIG. 6, in the present embodiment, arm portion 21 and root portion 3 are formed from different members respectively. Disc 20 is implemented by combining these portions. Specifically, arm portion 21 is formed from a ferromagnetic material, while root portion 3 is formed from a material of high strength. Root portion 3 may be formed from a non-magnetic material. Low-carbon iron represents one example of a material for forming arm portion 21. Examples of a material for forming root portion 3 includes high-carbon iron and an iron alloy such as chromium molybdenum steel and alloy tool steel SKD (JIS code).

Figure 7:
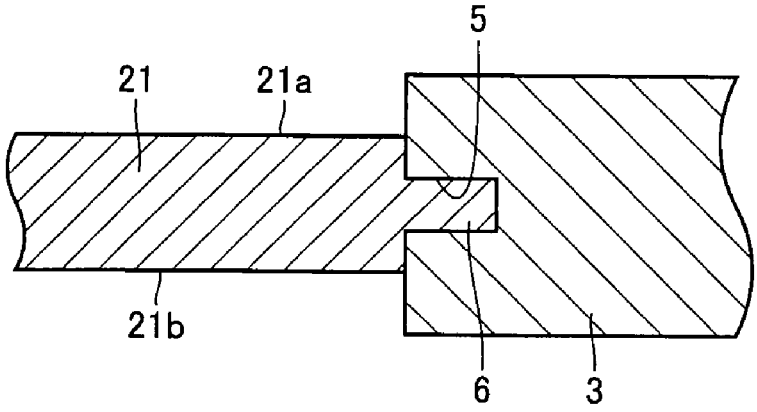
FIG. 7 is a cross-sectional view along the line VII-VII in FIG. 6.

Referring to FIG. 7, a groove 5 is formed in an end surface of root portion 3 facing arm portion 21, and a fitting portion 6 projecting from an end surface facing root portion 3 is formed on arm portion 21. A boundary is welded while fitting portion 6 is press-fitted into groove 5, so as to join root portion 3 and arm portion 21 together.

According to the electromagnetically driven valve in the second embodiment of the present invention structured as above, an effect similar to that in the first embodiment can be obtained. In addition, as root portion 3 is formed from a material of high strength, prevention of breakage of root portion 3 can further be ensured. Moreover, even if disc 20 has a smaller overall thickness, the strength of root portion 3 can be ensured. In this manner, the total weight of disc 20 is reduced, and electric power to be introduced into coils 32 and 37 can further be suppressed.

Third Embodiment

In the following, the electromagnetically driven valve according to the present embodiment will be compared with electromagnetically driven valve 10 according to the first embodiment. Description of a redundant structure will not be repeated.

Figure 8:
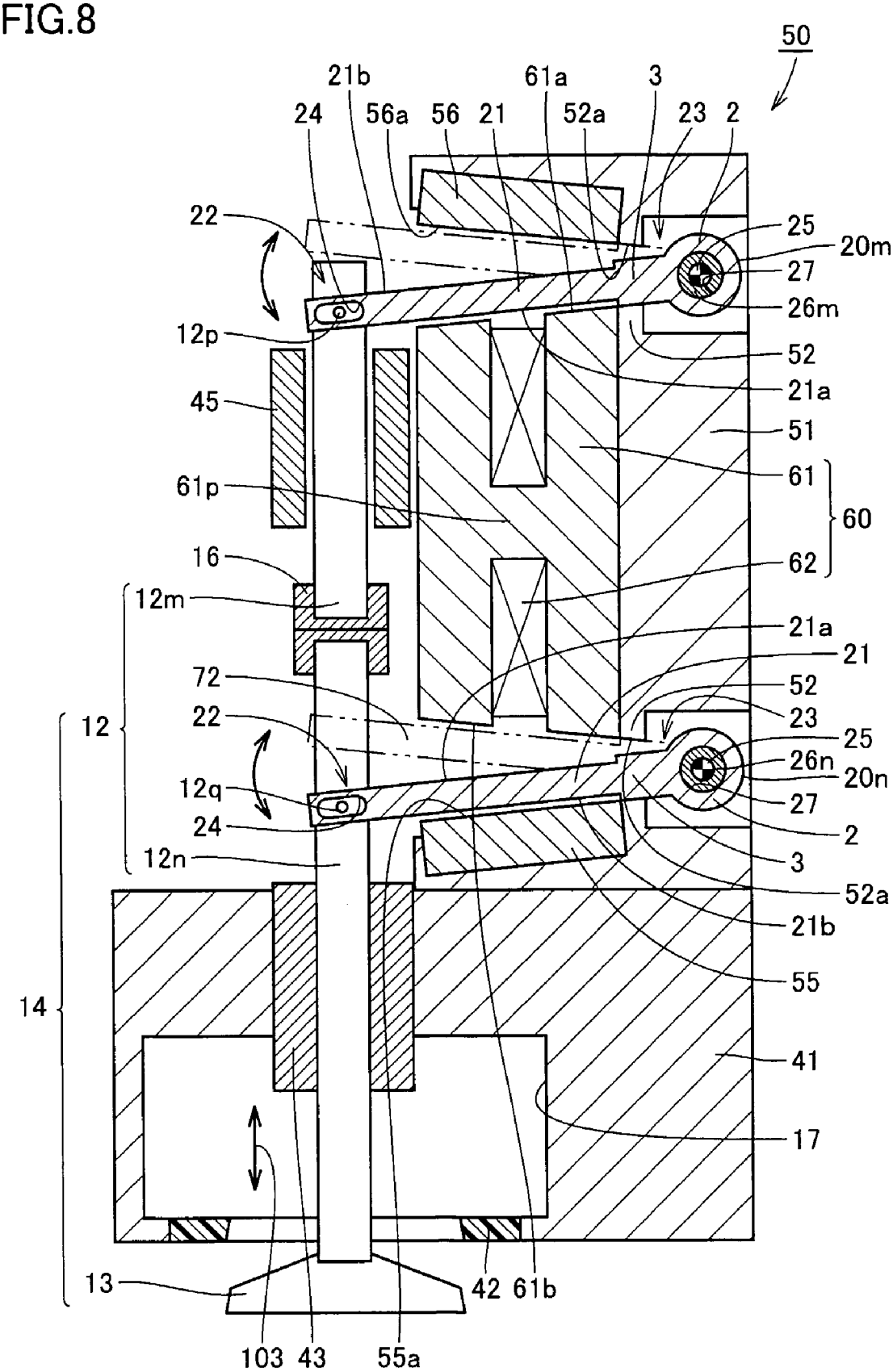
FIG. 8 is a cross-sectional view showing an electromagnetically driven valve according to a third embodiment of the present invention.

Referring to FIG. 8, an electromagnetically driven valve 50 is a rotary drive type electromagnetically driven valve. As an operation mechanism for the electromagnetically driven valve, a parallel link mechanism is applied. In the present embodiment, electromagnetically driven valve 50 includes an upper disc 20*m* and a lower disc 20*n* coupled to different positions on stem 12 respectively and oscillating upon receiving electromagnetic force and elastic force, an electromagnet 60 arranged between upper disc 20*m* and lower disc 20*n* and generating the electromagnetic force, and an upper spring 26*m* and a lower spring 26*n* provided in upper disc 20*m* and lower disc 20*n* respectively and applying the elastic force to these discs. Upper disc 20*m* and lower disc 20*n* are supported in a freely oscillating manner around fulcrum 25 by disc support base 51 at positions spaced apart from each other in a direction in which stem 12 extends.

Stem 12 is constituted of a lower stem 12*n* continuing from umbrella-shaped portion 13 and an upper stem 12*m* connected to lower stem 12*n* with a lash adjuster 16 being interposed. Lash adjuster 16 serves to accommodate registration error of driven valve 14 at the valve-closing position, as well as to reliably bring umbrella-shaped portion 13 into contact with valve seat 42. Lower stem 12*n* has a coupling pin 12*q* projecting from its outer circumferential surface formed, and upper stem 12*m* has a coupling pin 12*p* projecting from its outer circumferential surface formed in a position apart from coupling pin 12*q*. In upper stem 12*m*, a stem guide 45 for slidably guiding upper stem 12*m* in an axial direction is provided. Stem guide 45 is formed from a material similar to that for valve guide 43.

Upper disc 20*m* and lower disc 20*n* are structured substantially similarly to disc 20 in the first embodiment. On the other hand, one end 22 has an elongated hole 24 formed, instead of projection 4. One end 22 of upper disc 20*m* is coupled to upper stem 12*m* so as to allow free oscillation of the disc by insertion of coupling pin 12*p* into elongated hole 24 formed in upper disc 20*m*. One end 22 of lower disc 20*n* is coupled to lower stem 12*n* so as to allow free oscillation of the disc by insertion of coupling pin 12*q* into elongated hole 24 formed in lower disc 20*n*. With such a structure, upper disc 20*m* and lower disc 20*n* oscillate around fulcrum 25 respectively, so as to cause driven valve 14 to reciprocate.

Upper spring 26*m* and lower spring 26*n* are implemented by torsion bars. Upper spring 26*m* applies the elastic force to upper disc 20*m* in such a direction that upper disc 20*m* pivots counterclockwise around fulcrum 25, that is, in a direction lowering stem 12. Lower spring 26*n* applies the elastic force to lower disc 20*n* in such a direction that lower disc 20*n* pivots clockwise around fulcrum 25, that is, in a direction elevating stem 12. While the electromagnetic force from electromagnet 60 is not applied, upper disc 20*m* and lower disc 20*n* are positioned by upper spring 26*m* and lower spring 26*n* respectively at the position intermediate between the oscillation end on the valve-opening side and the oscillation end of the valve-closing side.

Electromagnet 60 is constituted of a coil 62 and a core 61 having surfaces 61*a* and 61*b* facing surfaces 21*a* of upper disc 20*m* and lower disc 20*n* respectively. Core 61 has a shaft portion 61*p* extending in a direction from one end 22 to the other end 23 of upper disc 20*m* or lower disc 20*n*. Coil 62 is provided in a manner wound around shaft portion 61*p*.

Disc support base 51 includes a valve-opening permanent magnet 55 and a valve-closing permanent magnet 56 located on a side opposite to valve-opening permanent magnet 55 with electromagnet 60 being interposed. Valve-opening permanent magnet 55 has a surface 55*a* facing surface 21*b* of lower disc 20*n*. A space in which lower disc 20*n* oscillates is defined between surface 55*a* and surface 61*b* of electromagnet 60. In addition, valve-closing permanent magnet 56 has a surface 56*a* facing surface 21*b* of upper disc 20*m*. A space in which upper disc 20*m* oscillates is defined between surface 56*a* and surface 61*a* of electromagnet 60.

In the present embodiment as well, a pair of abutment portions 52 each having abutment surface 52*a* is provided in disc support base 51, above and below root portion 3 of upper disc 20*m* and lower disc 20*n*. When root portion 3 abuts on abutment surface 52*a*, movement at the oscillation ends of upper disc 20*m* and lower disc 20*n* is restricted. When upper disc 20*m* and lower disc 20*n* are at the oscillation end, gaps are created between surfaces 21*a* of upper disc 20*m* and lower disc 20*n* and surfaces 61*a*, 61*b* of electromagnet 60, respectively. In addition, gaps are created between surfaces 21*b* of upper disc 20*m* and lower disc 20*n* and surfaces 56*a*, 55*a* of valve-closing permanent magnet 56 and valve-opening permanent magnet 55, respectively.

Figure 9:
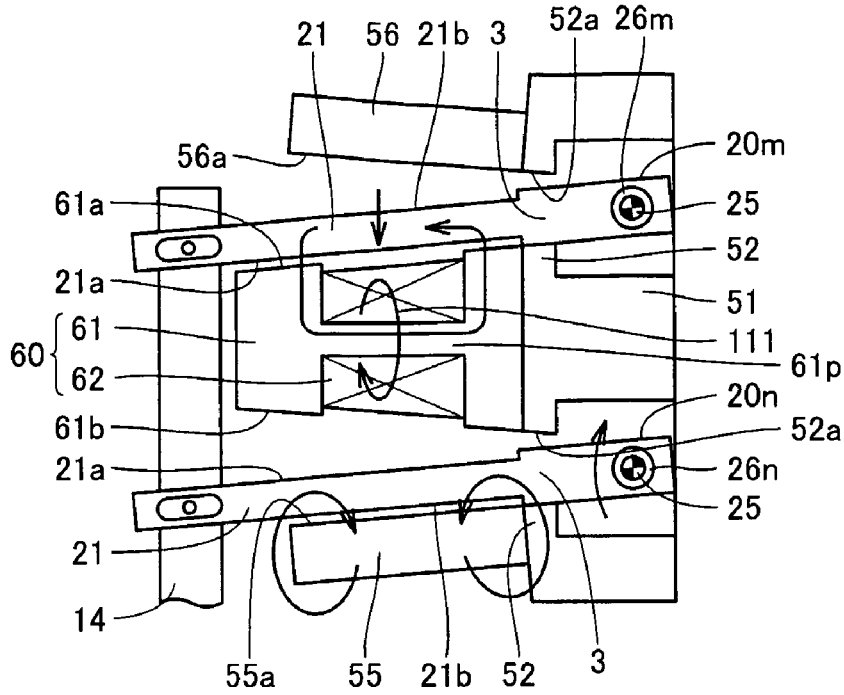
FIG. 9 is a schematic diagram showing an upper disc and a lower disc at an oscillation end on a valve-opening side.

An operation of electromagnetically driven valve 50 will now be described. Referring to FIG. 9, when driven valve 14 is at the valve-opening position, coil 62 is supplied with a current flowing in a direction shown with an arrow 111 around shaft portion 61*p* of core 61. Here, on a side where upper disc 20*m* is located, the current flows from the back toward the front of the sheet showing FIG. 9. Accordingly, magnetic flux flows in core 61 in a prescribed direction, and the electromagnetic force attracting upper disc 20*m* toward surface 61*a* of electromagnet 60 is generated. On the other hand, lower disc 20*n* is attracted to surface 55*a* by valve-opening permanent magnet 55. Consequently, upper disc 20*m* and lower disc 20*n* resist the elastic force of lower spring 26*n* arranged around fulcrum 25, and are held at the oscillation end on the valve-opening side shown in FIG. 9.

Figure 10:
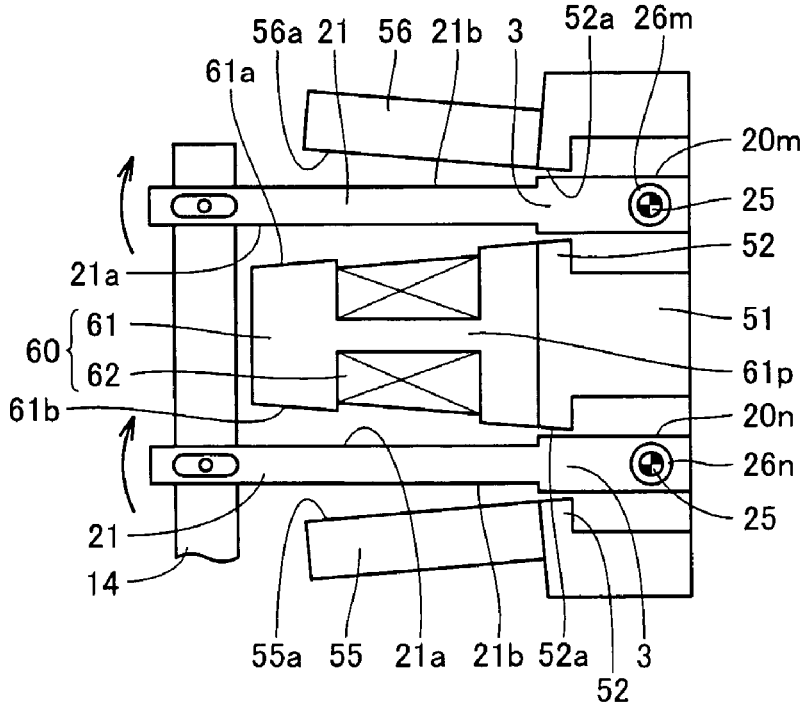
FIG. 10 is a schematic diagram showing the upper disc and the lower disc at an intermediate position.

Referring to FIG. 10, when current supply to coil 62 is stopped, the electromagnetic force generated by electromagnet 60 disappears. Then, upper disc 20*m* and lower disc 20*n* move away from surfaces 61*a* and 55*a* by the elastic force of lower spring 26*n* respectively, and start to oscillate toward the intermediate position. The elastic force by lower spring 26*n* and upper spring 26*m* attempts to hold upper disc 20*m* and lower disc 20*n* at the intermediate position. Therefore, at the position beyond the intermediate position, force in a direction reverse to the oscillating direction acts on upper disc 20*m* and lower disc 20*n* from upper spring 26*m*. On the other hand, as inertial force acts on upper disc 20*m* and lower disc 20*n* in the oscillating direction, upper disc 20*m* and lower disc 20*n* oscillate as far as the position beyond the intermediate position.

Figure 11:
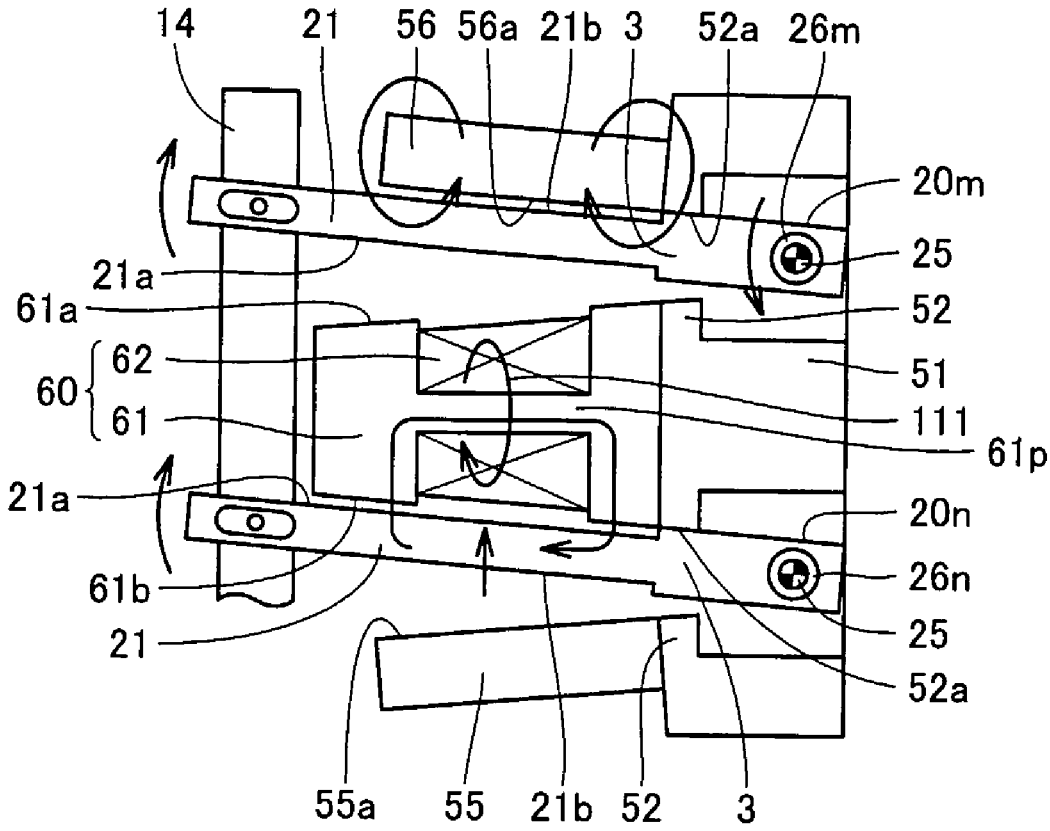
FIG. 11 is a schematic diagram showing the upper disc and the lower disc at an oscillation end on a valve-closing side.

Referring to FIG. 11, at the position beyond the intermediate position, a current is again fed to coil 62 in a direction shown with arrow 111. Here, on a side where lower disc 20*n* is located, the current flows from the front toward the back of the sheet showing FIG. 11. Accordingly, magnetic flux flows in core 61 in a prescribed direction, and the electromagnetic force attracting lower disc 20*n* toward surface 61*b* of electromagnet 60 is generated. On the other hand, upper disc 20*m* is attracted to surface 56*a* by valve-closing permanent magnet 56.

Here, upper disc 20*m* is also attracted to surface 61*a* of electromagnet 60 by the electromagnetic force generated by electromagnet 60. Here, the electromagnetic force is stronger between lower disc 20*n* and electromagnet 60 because a space therebetween is narrow. Therefore, upper disc 20*m* and lower disc 20*n* oscillate from the position beyond the intermediate position to the oscillation end on the valve-closing side shown in FIG. 11.

Thereafter, current supply to coil 62 is repeatedly started and stopped at a timing described above. In this manner, upper disc 20*m* and lower disc 20*n* are caused to oscillate between the oscillation ends on the valve-opening side and the valve-closing side, so that driven valve 14 can carry out the reciprocating motion as a result of this oscillating movement.

In electromagnetically driven valve 50 according to the third embodiment of the present invention, upper disc 20*m* and lower disc 20*n* serving as a plurality of oscillating members are provided on opposing sides of electromagnet 60 respectively.

According to electromagnetically driven valve 50 according to the third embodiment of the present invention structured as above, an effect similar to that in the first embodiment can be obtained. In the present embodiment, as electromagnetically driven valve 50 includes a plurality of discs, sound produced by collision between upper disc 20*m*, lower disc 20*n* and electromagnet 60 tends to be particularly problematic. In order to address such a problem, the present invention expected to improve quietness can particularly effectively be utilized. It is noted that the disc structure described in the second embodiment may be applied to electromagnetically driven valve 50 in the present embodiment, and in such a case, the effect achieved in the second embodiment can also be attained.

Although the present invention has been described and illustrated in detail, it is clearly understood that the same is by way of illustration and example only and is not to be taken by way of limitation, the spirit and scope of the present invention being limited only by the terms of the appended claims.

INDUSTRIAL APPLICABILITY

The present invention is mainly utilized as an intake valve or an exhaust valve in a gasoline engine, a diesel engine, or the like.

The invention claimed is:

1. An electromagnetically driven valve, comprising:

a driven valve having a valve shaft and carrying out reciprocating motion along a direction in which said valve shaft extends;

a support member having an abutment surface and provided at a position spaced apart from said driven valve;

an oscillating member extending from one end coupled to said valve shaft to the other end supported by said support member so as to allow free oscillation of the oscillating member, and having a root portion formed at said other end and an arm portion formed from said root portion to said one end; and an electromagnet having a surface facing said arm portion and applying electromagnetic force to said oscillating member; wherein when said oscillating member is attracted to said electromagnet, said abutment surface abuts on said root portion and a gap is created between said surface and said arm portion.

2. The electromagnetically driven valve according to claim 1, wherein said oscillating member is formed such that said arm portion has a thickness smaller than that of said root portion.

3. The electromagnetically driven valve according to claim 1, wherein said root portion is formed from a material of higher strength than said arm portion.

* * * * *